US006431890B1

(12) United States Patent
Li et al.

(10) Patent No.: US 6,431,890 B1
(45) Date of Patent: Aug. 13, 2002

(54) PRINTED CIRCUIT BOARD SOCKET WITH GUIDES FOR ALIGNING AND FOR RELEASING A PRINTED CIRCUIT BOARD

(76) Inventors: Kin Ip Li; Chun Kong Chan, both of No. 13, 8/F, Vanta Industrial Centre, 33, Tai Lin Pai Road, Kwai Chung, Hong Kong (HK); Kin Wah Kong, 43 Woodman's Chart, Markham, Ontario (CA), L3R 6K8

( * ) Notice: Subject to any disclaimer, the term of this patent is extended or adjusted under 35 U.S.C. 154(b) by 39 days.

(21) Appl. No.: 09/634,593

(22) Filed: Aug. 8, 2000

(51) Int. Cl.[7] ..... H01R 13/62

(52) U.S. Cl. ..... 439/160; 439/325; 439/377; 439/630

(58) Field of Search ..... 439/157, 159, 439/160, 325, 326, 327, 629, 630, 377

(56) References Cited

U.S. PATENT DOCUMENTS

| | | | | |
|---|---|---|---|---|
| 3,651,444 A | * | 3/1972 | Desso et al. | 339/42 |
| 4,713,013 A | | 12/1987 | Regnier et al. | 439/62 |
| 5,013,257 A | | 5/1991 | Korsunsky et al. | 439/326 |
| 5,139,430 A | * | 8/1992 | Lewis et al. | 439/157 |
| 5,161,995 A | | 11/1992 | Bakke et al. | 439/326 |
| 5,169,333 A | | 12/1992 | Lee | 439/326 |
| 5,389,000 A | * | 2/1995 | DiViesti et al. | 439/157 |
| 5,411,408 A | | 5/1995 | DiViesti et al. | 439/326 |
| 5,427,536 A | | 6/1995 | Petersen et al. | 439/71 |
| 5,755,585 A | | 5/1998 | Cheng et al. | 439/326 |
| 5,781,414 A | * | 7/1998 | Mills et al. | 361/786 |
| 5,906,501 A | | 5/1999 | Longueville et al. | 439/327 |
| 5,953,473 A | | 9/1999 | Shimotsu et al. | 385/56 |
| 5,964,606 A | | 10/1999 | Choy | 439/160 |
| 6,004,139 A | | 12/1999 | Dramstad et al. | 439/59 |

* cited by examiner

*Primary Examiner*—Tho D. Ta
*Assistant Examiner*—Truc Nguyen
(74) *Attorney, Agent, or Firm*—Siemens Patent Services LC

(57) ABSTRACT

A socket having a slot with an array of terminals for providing an electrical connection with an array of terminals on the edge of a printed circuit board includes an alignment mechanism for progressively correcting any misalignment between the board and the slot as the board is moved towards and inserted into the slot. The alignment mechanism includes a pair of guides supported near opposed ends of the slot. Each of the guides includes a base surface and guide surfaces sloping upwardly and away from the base surface. The socket may also include a release mechanism interactive with the alignment mechanism.

14 Claims, 5 Drawing Sheets

PRINTED CIRCUIT BOARD SOCKET WITH GUIDES FOR ALIGNING AND FOR RELEASING A PRINTED CIRCUIT BOARD

FIELD OF THE INVENTION

The present invention relates generally to electrical connectors or sockets for making edge connections with printed circuit boards (PCBs). Although not limited, it is particularly adapted for making edge connections with PCBs that are being subjected to quality evaluation or other testing in an automated environment. Such PCBs include but are not limited to Dual In-Line Memory Modules (DIMMs), SO-DIMMs (Small Outline DIMMs) and RIMMs (RAMBUS In-Line Memory Modules).

BACKGROUND TO THE INVENTION

There are a wide variety of known electrical connectors or sockets for making edge connections with PCBs. Some include surfaces for guiding a PCB during connection with the socket. Others include release mechanisms to facilitate removal of a PCB from a socket. However, none appear to be adapted or well adapted to progressively correct initial misalignments that may be present when a PCB is being inserted into its socket. Further, none appear to provide a release mechanism that is interactive with an alignment mechanism.

A suitable alignment mechanism can be particularly desirable in automated testing environments where a testing jig, including a PCB test socket, is used as part of a quality evaluation program or otherwise to test PCBs at the output of a PCB production line. In such environments, robotic controls may be used to automatically handle and insert each PCB into the test socket. If so, then the robotic control itself must have the means to ensure that the PCB is precisely aligned with the test socket before insertion. Alternatively, the test socket must offer a means for correcting any misalignment before insertion.

Accordingly, a primary object of the present invention is to provide an electrical socket for a PCB which has a new and improved alignment mechanism serving to progressively correct misalignment between the PCB and the socket as the PCB is inserted into the socket.

A further object of the present invention is to provide a socket of the foregoing type which includes a release mechanism interactive with the alignment mechanism.

SUMMARY OF THE INVENTION

In a broad aspect of the present invention, there is provided an electrical socket of the type comprising a main housing having an elongated slot-for receiving a mating edge of a PCB such that an array of electrical terminals spaced along the edge frictionally engages and electrically connects with a corresponding array of electrical terminals carried within the housing. The socket includes a pair of guides supported near opposed ends of the slot for aligning the board with the slot as the edge is inserted into the slot. Each of the guides includes a base surface and guide surfaces sloping upwardly and away from the base surface for directing the edge to register with the slot while progressively correcting misalignment between the edge and the slot. In a preferred embodiment, the guide surfaces include an opposed pair of guide surfaces sloping upwardly and away from opposed sides of the base surface, and a guide surface that extends between the opposed pair of guide surfaces and also slopes upwardly and away from said base surface.

Preferably, the guide surfaces include a sloped planar surface extending upwardly from the base surface of the guide in a direction longitudinally away from the slot; and an opposed pair of sloped planar surfaces extending upwardly from the base surface in a direction transverse to the longitudinal direction of the slot.

Further, each of the guides is preferably carried by an associated guide support which permits movement of the guide upwardly and downwardly relative to the slot, each of the guides being biased (for example, by a compression spring) towards an upper position. When the edge of the PCB is fully received by the slot, the strength of the bias is insufficient to overcome the force of frictional engagement between the array of electrical terminals spaced along the edge and the corresponding array of electrical terminals carried within the main housing.

Advantageously, each of the guide supports includes a release lever for forcibly moving the associated guide from a lower position towards an upper position against the force of frictional engagement between the edge array of PCB terminals and the array of terminals carried within the main housing. In a preferred embodiment, each release lever is pivotally mounted to its associated guide support and is pivotally biased (for example, by a torsion spring) to a position permitting its associated guide to be moved to a lower position in the guide support without interference from the lever.

The foregoing and other features and advantages of the invention will now be described with reference to the drawings.

DETAILED DESCRIPTION OF PREFERRED EMBODIMENTS

Figure 1:
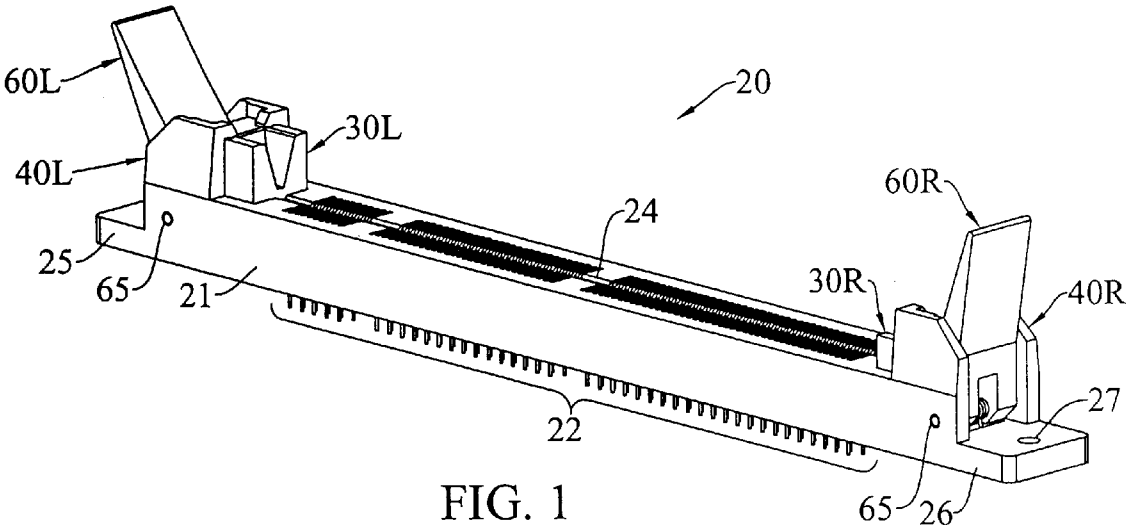
FIG. 1 is a perspective view of a 168-pin printed circuit board test socket in accordance with the present invention.
Figure 15:
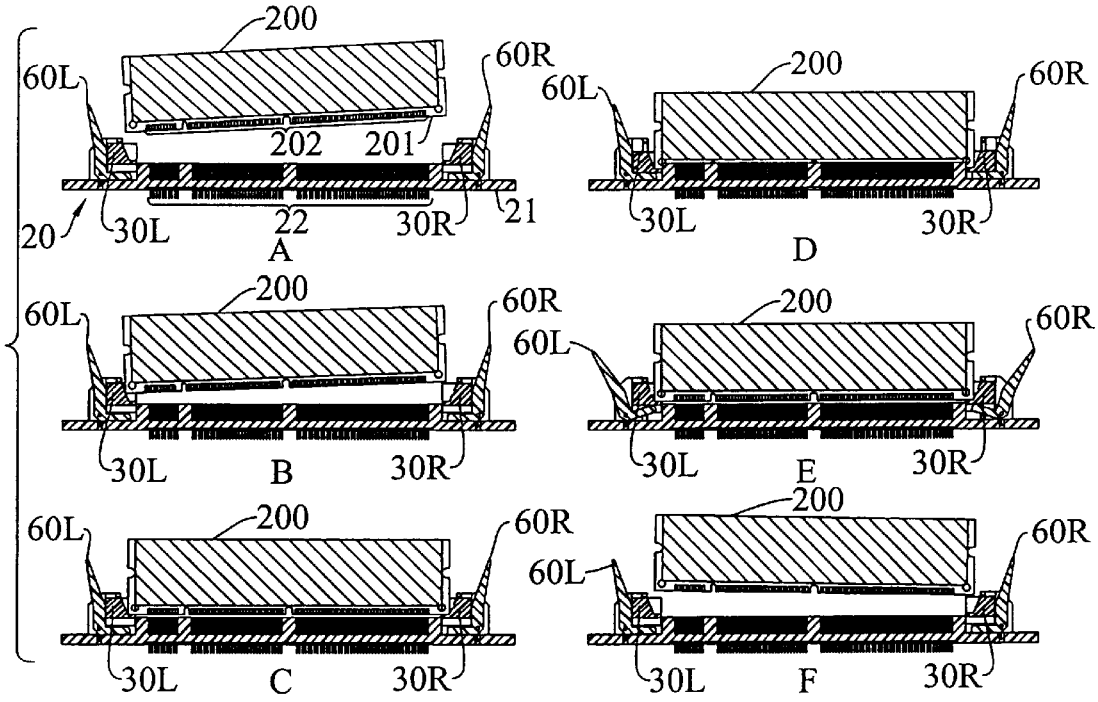
FIG. 15 is a sequence of section elevation views A to F illustrating the insertion of a printed circuit board in the socket shown in FIG. 1, and its subsequent removal from the socket.
Figure 16:
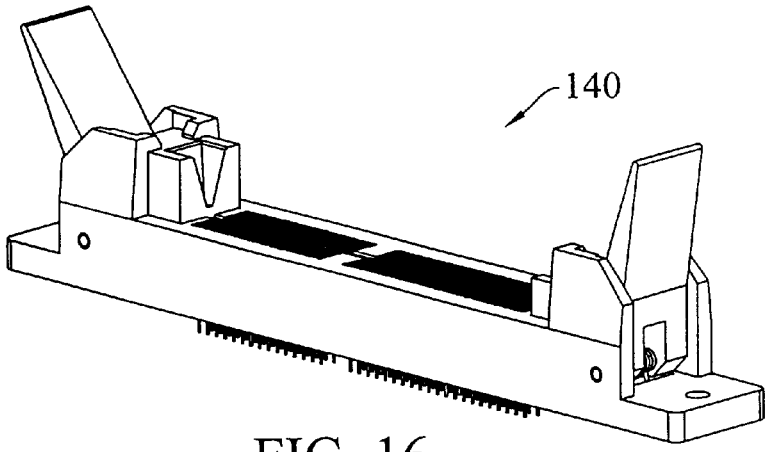
FIG. 16 is a perspective view of a 144-pin printed circuit board test socket in accordance with the present invention.
Figure 17:
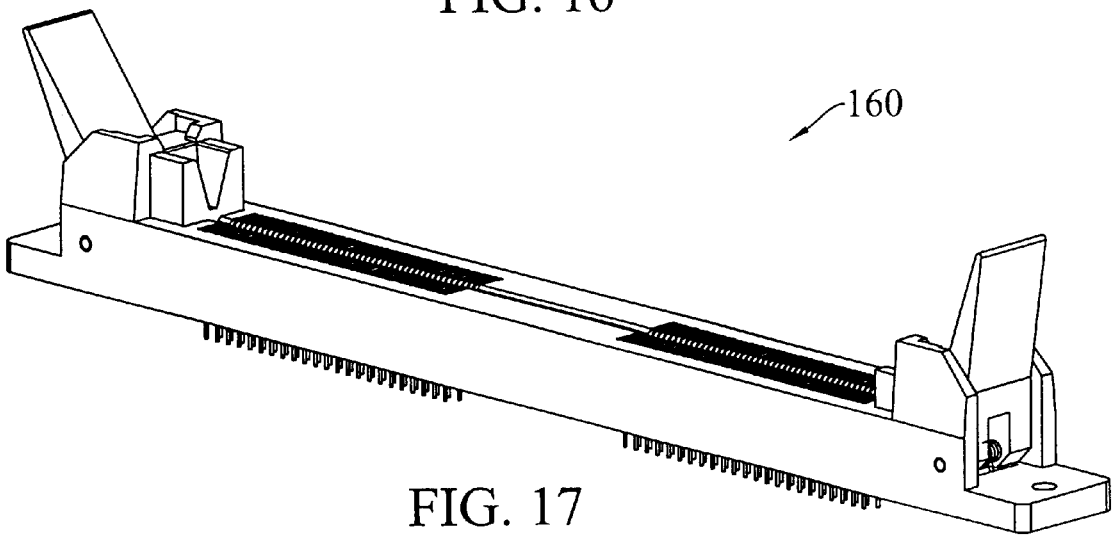
FIG. 17 is a perspective view of a 184-pin printed circuit board test socket in accordance with the present invention.

The drawings illustrate three basic embodiments of the present invention, the first being the 168-pin PCB test socket generally designated 20 in FIG. 1, the second being the 144-pin PCB test socket generally designated 140 in FIG. 16, and the third being the 184-pin PCB test socket generally designated 160 in FIG. 17. For the purpose of discussion, most of the drawings (FIGS. 1 to 15) and most of the description that follows are focused on the 168-pin embodiment. However, as will become apparent, all embodiments share common features that serve to define the present invention.

Referring now to FIGS. 1–15, socket 20 includes a main housing 21 having an elongated slot 24 for receiving the mating edge 201 of a 168-pin PCB 200. When PCB 200 is properly received within slot 24, an array of pads or electrical terminals 202 spaced along edge 201 frictionally engage and electrically mate with a corresponding array of electrical terminals 22 carried by and extending from housing 21. Note: PCB 200 is shown only in FIG. 15, and only a lower part thereof is shown.

Flanges 25, 26 at opposed lower ends of housing 21 each include a screw or bolt hole 27 to enable the housing to be secured to a desired platform (not shown).

At this juncture, it should be emphasized that the mere provision of a housing that can be secured to a desired platform, the housing including an elongated slot for receiving the leading edge of a PCB such that an array of pads or terminals on the PCB frictionally engage and electrically mate with a corresponding array of terminals carried by and extending from the housing is well known to those skilled in the art. Typically, the housing is a dielectric housing. Necessarily, the arrangement and spacing of terminals in the housing must be made having in mind the arrangement and spacing of pads or terminals on the PCB, and this will differ from case to case depending on the PCB. Accordingly, the foregoing aspects of design are not discussed here. The present example of a socket which is designed to accommodate a 168-pin PCB has in mind that the PCB is a conventional 168-pin Dual In-Line Memory Module (DIMM).

In more detail, socket 20 includes a pair of guides generally designated 30L, 30R supported near opposed ends of slot 24 for aligning the PCB with slot 24 as edge 201 of the PCB is inserted into the slot. Both guides are basically identical in construction. However, to facilitate the discussion that follows, the letters "L" or "R", as the case may be, have been added to the numeric designation "30" and to certain other numeric designations to more easily focus the reader's attention on components positioned towards the left side ("L") or the right side ("R") of socket 20 as it appears in the FIGURES.

Figure 12:
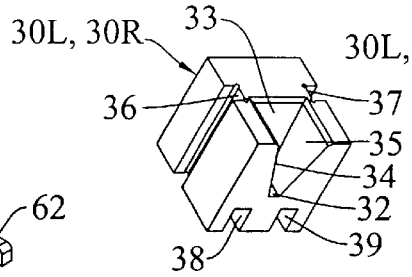
FIG. 12 is a perspective view showing in more detail one of two printed circuit board guides forming part of the socket shown in FIG. 1.
Figure 13:
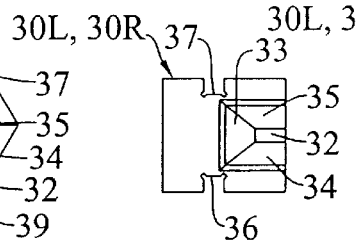
FIG. 13 is a top view of the guide shown in FIG. 12.
Figure 14:
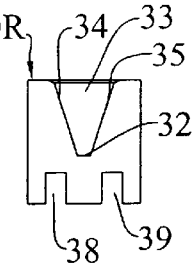
FIG. 14 is an end elevation view of the guide shown in FIG. 12.

As best seen in FIGS. 12–14, each guide 30L, 30R includes a base surface 32 and guide surfaces 33, 34 and 35 sloping upwardly and outwardly from the base surface. A first pair of rectangular grooves 36, 37 extend vertically and in parallel along opposite sides of each guide. Similarly, a second pair of rectangular grooves 38, 39 extend horizontally and in parallel in the base of each guide between the opposite sides. The width of base surface 32 is toleranced marginally greater than the thickness of the lower comers of PCB 200. This permits a lower comer of the PCB to sit on the base surface between guide surfaces 34, 35.

Guide surfaces 34, 35 are opposed planar surfaces sloping upwardly and away from base surface 32. Guide surface 33 extends between guide surfaces 34, 35 and also slopes upwardly and away from base surface 32. As is described hereinafter, guide surfaces 33, 34 and 35 serve to direct edge 201 to register with slot 24. Misalignment between the edge and the slot is progressively corrected.

Each guide 30L, 30R is carried by an associated guide support generally designated 40L, 40R and extending upwardly from housing 21. As best seen in FIGS. 7 to 10, each guide support includes a pair of outer walls 42, 44 having inwardly extending rails or flanges 43, 45. Tabs 47, 49 extend inwardly from the tops of the respective flanges. Such flanges slidingly mate with grooves 36, 37 in the associated guide. Guides 30L, 30R are thereby constrained by their associated guide supports 40L, 40R to move only upwardly or downwardly within their respective supports.

The distance between guide supports 40L, 40R is predetermined by the distance between the lower corners of PCB 200 and the geometry of guides 30L, 30R. More particularly, guides 30L, 30R are carried by supports 40L, 40R such that the distance between the bottom of guide surface 33 in guide 30L and the bottom of guide surface 33 in guide 30R is toleranced marginally greater the distance between the lower comers of PCB 200 (viz. the bottom width of PCB 200).

Figure 6:
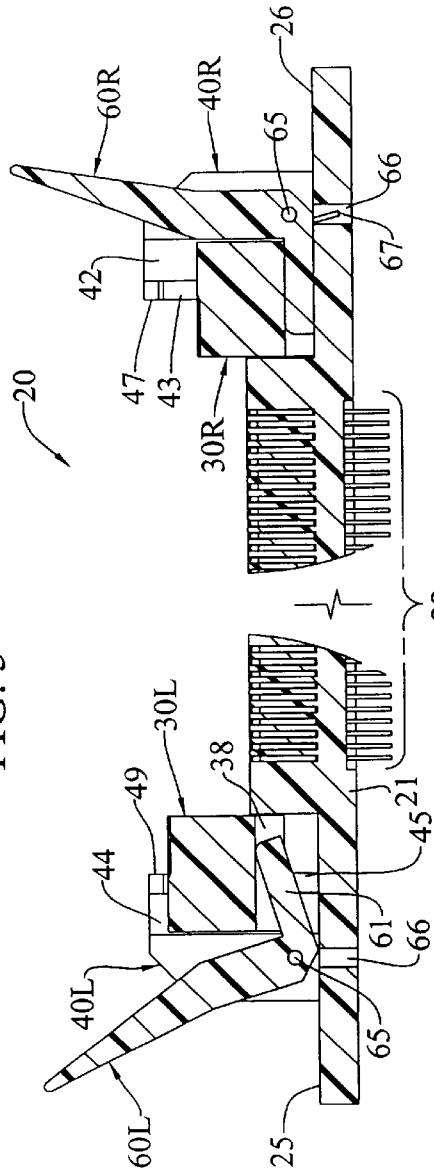
FIG. 6 is a section elevation view, partially cut away, taken along section line 6—6 in FIG. 5.
Figure 7:
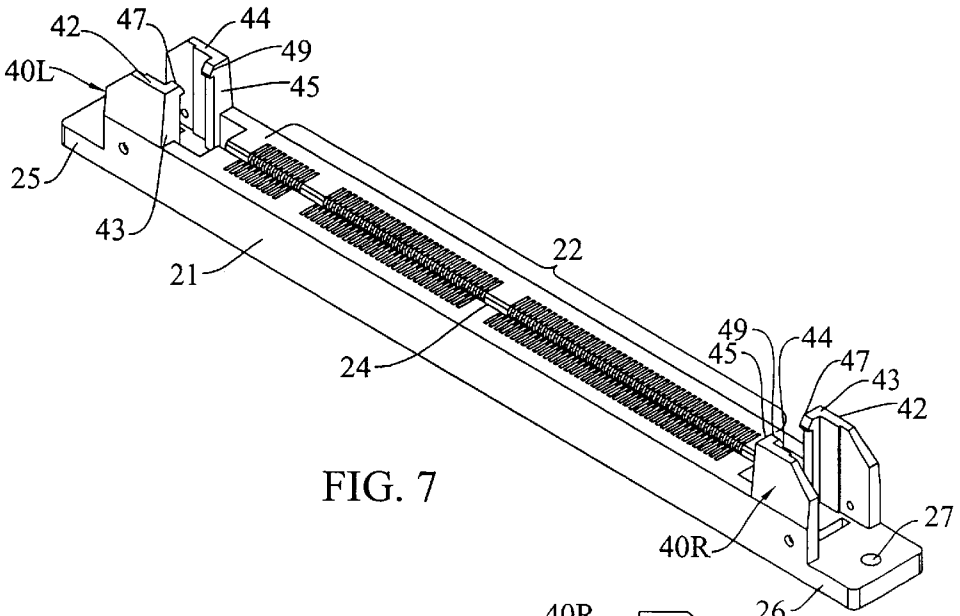
FIG. 7 is a perspective view of the main housing forming part of the socket shown in FIG.1.
Figure 8:
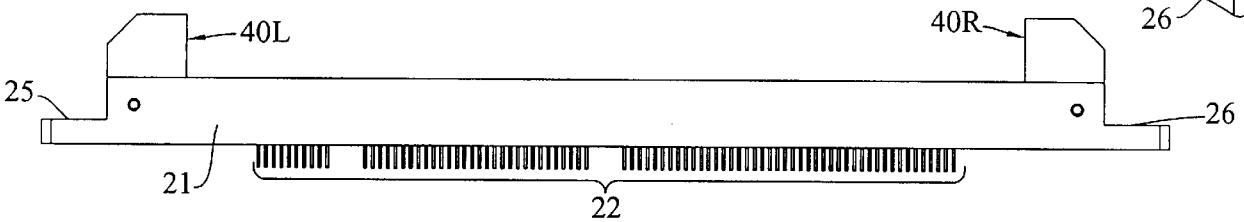
FIG. 8 is a front elevation view of the main housing shown in FIG. 7.
Figure 10:
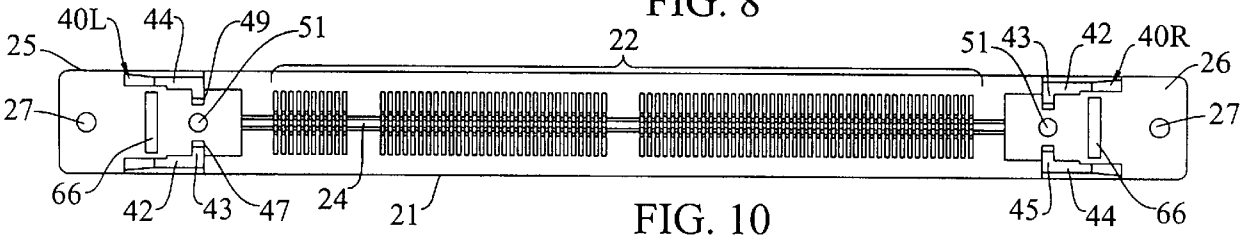
FIG. 10 is a top view of the main housing shown in FIG. 7.
Figure 9:
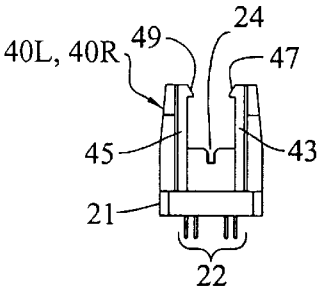
FIG. 9 is an end elevation view of the main housing shown in FIG. 7.
Figure 11:
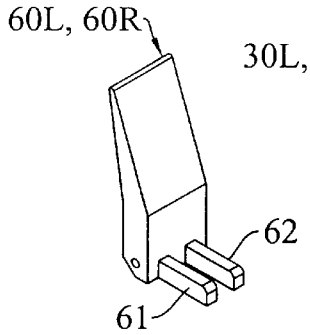
FIG. 11 is a perspective view showing in more detail one of two release levers forming part of the socket shown in FIG. 1.

The range of movement of guides 30L, 30R within supports 40L, 40R is best indicated in FIG. 6. In FIG. 6, guide 30L is shown at an upper position. Concurrently, guide 30R is shown at a lower position. It should be noted that the lower position of guide 30R shown in FIG. 6 is not a natural position. In the absence of a sufficient force (not depicted) holding it to the lower position, guide 30R normally will be biased to an upper position like that of guide 30L: see below. The same applies in the case of guide 30L.

Normally, the uppermost positions of guides 30L, 30R within guide supports 40L, 40R will be limited by tabs 47, 49. However, it is to be noted that walls 42, 44 with their flanges 43, 45 are sufficiently flexible to be gently spread apart a small distance thereby enabling the guides to be installed in or removed from the guide supports.

Figure 2:
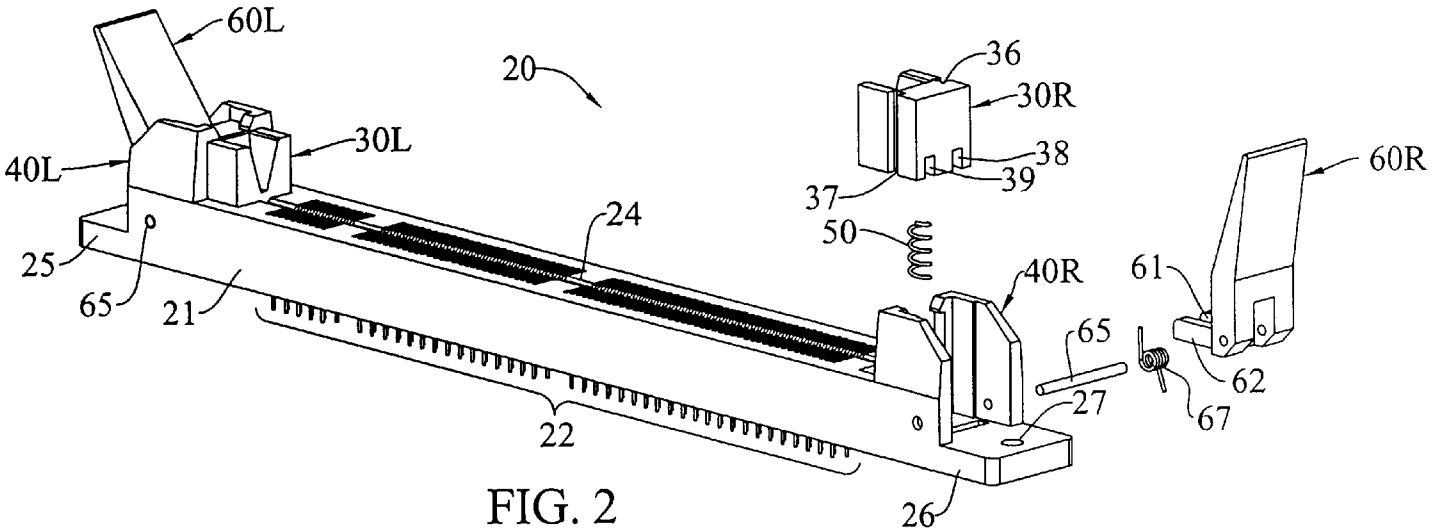
FIG. 2 is a perspective view, partially exploded, of the socket shown in FIG. 1.

As best seen with reference to guide support 40L in the exploded view portion of FIG. 2, each guide support 40L, 40R includes a compression spring 50 which is normally seated between housing 21 and the base of the associated guide 30L, 30R. In housing 21, the seatings for the lower ends of the compression springs are provided by holes 51 (see FIG. 10). Corresponding holes (not shown) are provided in the base of guides 30L, 30R to provide seatings for the upper ends of the compression springs. Compression springs 50 serve to provide a bias urging the associated guide towards their upper positions.

Guide supports 40L, 40R also include associated release levers generally designated 60L, 60R which are pivotally mounted to the support on a shaft 65 for rotation between a first position (viz. the upright position of lever 60R shown FIG. 6) and a second position (viz. the rocked position of lever 60L shown in FIG. 6). When a given lever is in the upright position, it permits its associated guide 30L, 30R, as the case may be, to be moved to its lower position in the guide without interference from the lever. Necessarily such movement is against the bias of the associated compression spring 50. When a given lever is pivoted to the rocked position, then it will forcibly move the associated guide 30L, 30R upwardly from its lower position if the movement of the guide is otherwise being restrained by frictional engagement between terminals 202 and terminals 22.

To facilitate suitable engagement between levers 60L, 60R and associated guides 30L, 30R, each lever includes a pair of rectangular arms or prongs 61, 62 (best seen in FIG. 11) which are sized and spaced to slidingly extend within grooves 38, 39 in the base of the guides. The actual engagement is best seen in FIG. 6 where, with reference to lever 60L, it will be seen that the distal end of prong 61 has engaged an underside of guide 30L within groove 38. Although not visible, prong 62 of lever 60L is similarly engaged within groove 39 of guide 30L.

Levers 60L, 60R are normally biased towards the upright position of lever 60R shown in FIG. 6. The rocked position of lever 60L requires the application of a suitable external force. For each lever, the bias is achieved by means of a torsion spring 67 mounted on shaft 65 of the associated guide support. The upper end of spring 67 engages the associated lever and, as best seen in FIG. 6, the lower end extends within and engages the wall of a slot 66 in housing 21.

The use of the invention will now be described with reference to FIG. 15. FIGS. 15A to 15F depict the insertion of PCB 200 into socket 20. FIGS. 15E and 15F depict the removal of PCB 200 from socket 20.

In more detail, FIG. 15A depicts an initial condition before any contact has occurred between PCB 200 and socket 20. Biased by springs 50, guides 30L, 30R are both in their uppermost positions and are set to receive PCB 200. Biased by springs 67 (likewise not shown in FIG. 15), release levers 60L, 60R are in their upright positions. PCB 200 is being lowered in rough alignment with socket 20 such that terminals 202 will be engaged by terminals 22. But, as is clearly visible in FIG. 15A, there is at least some rotational misalignment. In the vertical plane shown, edge 201 of PCB 200 has been rotated through a small counterclockwise angle relative to socket 20—and necessarily relative to slot 24 (not visible in FIG. 15) with which edge 201 ultimately must register). In addition, it can be assumed that there may be rotational misalignments in other planes (not shown) orthogonal to the plane of FIG. 15. As well, it may be assumed that there may be translational misalignments.

Notwithstanding such misalignments, it is assumed that there is a general alignment of the lower corners of PCB 200 above guide surfaces 33–35 (see FIGS. 12–14)) of guides 30L, 30R. In other words, when PCB 200 is lowered from the position shown in FIG. 15A, the corners of the PCB will descend within the regional envelopes defined by guide surfaces 33–35. However, it will be appreciated that the achievement of a geheral alignment above guide surfaces 33–35 of guides 30L, 30R will require significantly less precision than the ultimate alignment required between edge 201 and slot 24.

When PCB 200 is being inserted as shown in FIG. 15B, and in transition to the positions shown in FIG. 15C, the guide surfaces of guides 30L and/or 30R serve to direct edge 201 of PCB 200 to register with slot 24 while progressively correcting the initial misalignment. This result follows from the fact that misaligned lower comers of PCB 200 will eventually be required to steer down the slopes of the guide surfaces as the PCB continues to be moved downwardly. Ultimately, one comer will achieve a footing on base surface 32 of guide 30L, and the other will achieve a footing on base surface 32 of guide 30R. At this point, the initial misalignment will be fully corrected.

Of course, it will be understood by those skilled in the art that in any given case where there is an initial misalignment then only one or only some of the guide surfaces may be required to correct the misalignment. For example, if the only misalignment was the rotational misalignment visible in FIG. 15A, then the only guide surface that would play a role in the correction of the misalignment would be guide surface 33 of guide 30L.

Also, in cases where a robotic or similar mechanism is the agency that controls the lowering of PCB 200 towards socket 20, it will be understood by those skilled in the art that the position and orientation of PCB 200 should not be rigidly dictated by the robotic mechanism. In other words, if a guide surface of guide 30L or 30R urges the movement of PCB 200 in a particular direction, then the robotic mechanism should allow that movement to occur and should not offer resistance.

In FIGS. 15B and 15C, guides 30L, 30R (each biased by a spring 50) have remained at their upper positions. In FIG. 15C, full alignment has been achieved, but terminals 202 have not yet been engaged with terminals 22. At this point, a further downward force on PCB 200 is required to force edge 201 into slot 24 (viz. to the position shown in FIG. 15D) thereby achieving a frictional engagement and electrical connection between terminals 202 and terminals 22. Concurrently, guides 30L, 30R (which are now carrying the corners of PCB 200 on their base surfaces 32) are forced against the bias of their associated springs 50 to their lowermost positions. But, it is to be noted that the strength of such bias is insufficient to overcome the force of the frictional engagement.

Advantageously, guides 30L, 30R can be designed to stop the insertion of edge 201 into slot 24 before the bottom of the slot is reached. Such a feature may serve to lessen stresses on housing 21 and to avoid deformation that may otherwise result from long term usage.

The position shown in FIG. 15D is the normal position for testing or quality control evaluation of PCB 200. Once such testing has been completed, PCB 200 needs to be removed from socket 20 to enable testing of the next PCB. Such removal is illustrated in FIGS. 15E and 15F.

Figure 4:
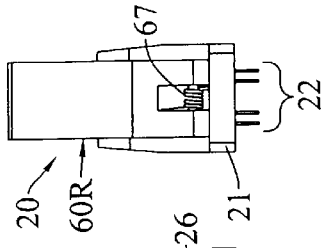
FIG. 4 is an end elevation view from the right of the socket as shown in FIG. 1.
Figure 3:
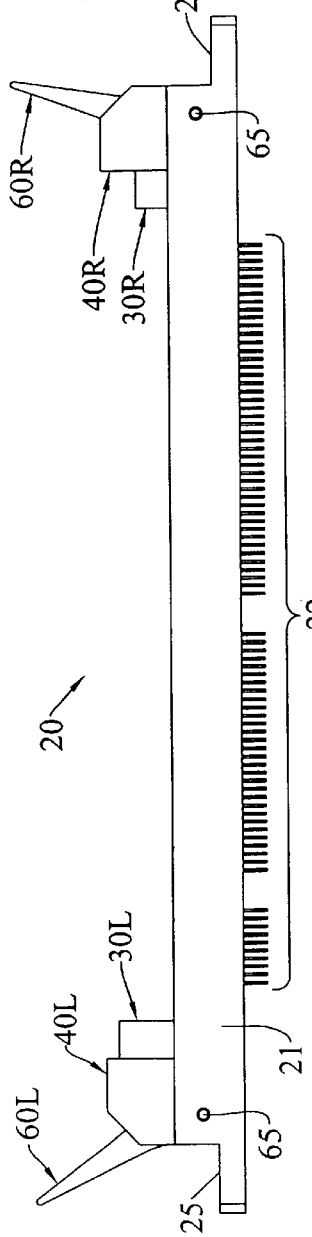
FIG. 3 is a front elevation view of the socket shown in FIG. 1.
Figure 5:
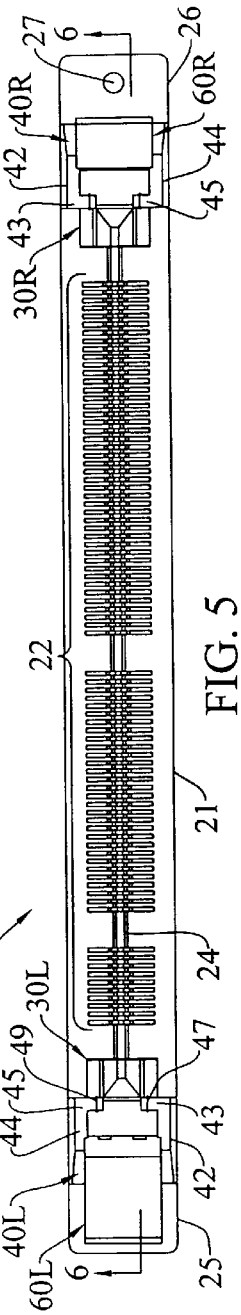
FIG. 5 is a top view of the socket shown in FIG. 1.

In FIG. 15E, release levers 60L, 60R have been manually pivoted to the positions shown against the bias of their associated torsion springs 67 (see FIGS. 1, 4). The result is to lift guides 30L, 30R to positions where terminals 202 are disengaged from terminals 22, the reason being that the vertical sliding distance of the guides on guide supports 40L, 40R is greater than the depth of insertion of terminals 202 in slot 24. As shown in FIG. 15F, PCB 200 is completely lifted away from socket 20. The socket is now ready to receive the next PCB.

Of course, it will be understood that it is not essential to use release levers 60L, 60R to remove PCB 200 from socket 20. A sufficient upward pulling force on PCB 200 will achieve the same result. If a pulling force is used, then it is preferably one that does not impose stresses on the socket by movements other than along the line of least resistance.

The guides, guide supports, and release levers of the 144-pin embodiment 140 depicted in FIG. 16, and the 184-pin embodiment 160 depicted in FIG. 17 are generally the same as those of the 168-pin embodiment depicted in FIGS. 1–15. The basic differences reside in the overall lengths of the sockets and the positioning of terminals within the housing.

A variety of modifications, changes and variations to the invention are possible within the spirit and scope of the following claims. The invention should not be considered as restricted to the specific embodiments which have been described and illustrated with reference to the drawings.

We claim:

1. In an electrical socket of the type comprising a main housing having an elongated slot for receiving a mating edge of a printed circuit board such that an array of electrical terminals spaced along said edge frictionally engages and electrically connects with a corresponding array of electrical terminals carried within said housing, the improvement comprising:

(a) a pair of guides supported near opposed ends of said slot for aligning said board with said slot as said edge is inserted into said slot, each of said guides being carried by an associated guide support permitting linear movement of the guide upwardly and downwardly relative to said slot, each of said guides being biased towards an upper position with a bias insufficient to cause disengagement of said array of electrical terminals spaced along said edge from said corresponding array of electrical terminals carried within said housing when said edge is fully received by said slot, (b) each of said guides including:

(i) a base surface; and, (ii) guide surfaces merging with and sloping upwardly and away from said base surface for directing said edge to register with said slot while progressively correcting misalignment between said edge and said slot.

2. An electrical socket as defined in claim 1, wherein said guide surfaces are planar surfaces.

3. An electrical socket as defined in claim 1, wherein each of said guides is biased towards its said upper position by a compression spring.

4. An electrical socket as defined in claim 1, wherein each of said guide supports includes a release lever for forcibly moving the associated guide from a lower position towards an upper position against said force of frictional engagement.

5. An electrical socket as defined in claim 4, wherein each of said levers is pivotally mounted to its associated guide support and is pivotally biased to a position permitting its associated guide to be moved to a lower position in the guide support without interference from the lever.

6. An electrical socket as defined in claim 5, wherein each of said levers is pivotally biased by a torsion spring.

7. An electrical socket as defined in claim 5, wherein:

(a) each of said guides is biased towards its said upper position by a compression spring; and, (b) each of said levers is pivotally biased by a torsion spring.

8. In an electrical socket of the type comprising a main housing having an elongated slot for receiving a mating edge of a printed circuit board such that an array of electrical terminals spaced along said edge frictionally engages and electrically connects with a corresponding array of electrical terminals carried within said housing, the improvement comprising:

(a) a pair of guides supported near opposed ends of said slot for aligning said board with said slot as said edge is inserted into said slot, each of said guides being carried by an associated guide support permitting linear movement of the guide upwardly and downwardly relative to said slot, each of said guides being biased towards an upper position with a bias insufficient to cause disengagement of said array of electrical terminals spaced along said edge from said corresponding array of electrical terminals carried within said housing when said edge is fully received by said slot, (b) each of said guides including:

(i) a base surface;

(ii) an opposed pair of guide surfaces merging with and sloping upwardly and away from opposed sides of said base surface; and, (iii) a third guide surface extending between said opposed pair of guide surfaces, said third guide surface merging with and sloping upwardly and away from said base surface, said guide surfaces for directing said edge to register with said slot while progressively correcting misalignment between said edge and said slot.

9. An electrical socket as defined in claim 4, wherein each of said levers is pivotally mounted to its associated guide support and is pivotally biased to a position permitting its associated guide to be moved linearly to a lower position in the guide support without interference from the lever.

10. An electrical socket as defined in claim 8, wherein each of said guides is biased towards its said upper position by a compression spring.

11. An electrical socket as defined in claim 8, wherein each of said guide supports includes a release lever for forcibly moving the associated guide from a lower position towards an upper position against said force of frictional engagement.

12. An electrical socket as defined in claim 11, wherein each of said levers is pivotally mounted to its associated guide support and is pivotally biased to a position permitting its associated guide to be moved to a lower position in the guide support without interference from the lever.

13. An electrical socket as defined in claim 12, wherein each of said levers is pivotally biased by a torsion spring.

14. An electrical socket as defined in claim 12, wherein:

(a) each of said guides is biased towards its said upper position by a compression spring; and, (b) each of said levers is pivotally biased by a torsion spring.

* * * * *